US005645713A

United States Patent [19]

Yan

[11] Patent Number: 5,645,713

[45] Date of Patent: Jul. 8, 1997

[54] THREE PHASE REMOVAL OF HALIDES FROM LIQUID HYDROCARBONS

[75] Inventor: Tsoung Y. Yan, Wayne, Pa.

[73] Assignee: Mobil Oil Corporation, Fairfax, Va.

[21] Appl. No.: 367,411

[22] Filed: Dec. 30, 1994

[51] Int. Cl.[6] ..... C10G 7/00; C10G 19/00; C10G 35/085

[52] U.S. Cl. ..... 208/308; 208/92; 208/134; 208/138; 208/139; 208/262.1; 208/284; 208/285

[58] Field of Search ..... 208/308, 92, 134, 208/138, 139, 262.1, 284, 285

[56] References Cited

U.S. PATENT DOCUMENTS

| | | | |
|---|---|---|---|
| 1,812,629 | 6/1931 | Gifford | 208/262.1 |
| 1,833,396 | 11/1931 | Gary | 208/286 |
| 1,913,619 | 6/1933 | Swartz | 208/97 |
| 1,914,668 | 6/1933 | Lachman | 208/262.1 |
| 2,479,110 | 8/1949 | Haensel | 208/139 |
| 2,481,300 | 6/1949 | Engel | 208/262.1 |
| 2,951,804 | 9/1960 | Juliard | 208/91 |
| 2,967,819 | 1/1961 | Leum et al. | 208/88 |
| 3,403,198 | 9/1968 | Van Pool | 208/262.1 |
| 3,445,381 | 5/1969 | Urban | 208/286 |
| 3,540,996 | 11/1970 | Maziuk et al. | 208/92 |
| 3,761,534 | 9/1973 | Sun et al. | 260/674 |
| 3,898,153 | 8/1975 | Louder et al. | 208/89 |
| 4,123,351 | 10/1978 | Chapman et al. | 208/262.1 |

FOREIGN PATENT DOCUMENTS

| | | | |
|---|---|---|---|
| 528153 | 7/1956 | Canada | 208/286 |

OTHER PUBLICATIONS

Copies of portions of "Opposers" work.

*Primary Examiner*—Glenn A. Caldarola
*Assistant Examiner*—Patricia L. Hailey
*Attorney, Agent, or Firm*—Thomas W. Steinberg

[57] ABSTRACT

Acidic halides, especially chlorides, are removed from liquid hydrocarbons such as catalytic reformate by contact with solid caustic such as a bed of NaOH pellets covered with a thin film of brine. Hydration of reformate improves removal when large amounts of chlorides are present in reformate. Halides in liquid hydrocarbon are recovered as a brine phase, which can be only slightly alkaline. Hydration of reformate can be controlled based on pH of brine removed from the bed.

15 Claims, 2 Drawing Sheets

THREE PHASE REMOVAL OF HALIDES FROM LIQUID HYDROCARBONS

CROSS-REFERENCE TO RELATED APPLICATIONS

This application is related to my prior co-pending application Ser. No. 08/217821 filed on Mar. 25, 1994.

This application is also related to other applications of mine filed simultaneously with this application directed to:

| DOCKET | TITLE |
|---|---|
| 08/367,500 | TWO PHASE TREATMENT OF VAPOR TO REMOVE HALIDES |
| 08/367,498 | REMOVAL OF ACIDIC HALIDES FROM GAS STREAMS |
| 08/367,501 | TWO PHASE REMOVAL OF HALIDES FROM LIQUID HYDROCARBONS |
| 08/367,499 | REMOVAL OF ACIDIC HALIDES FROM HOT GAS STREAMS AND ATTRITION REGENERATION OF CAUSTIC |
| 08/367,412 | DISSOLVING SALT ON SOLID CAUSTIC WITH OIL |
| 08/367,413 | NEUTRALIZING VAPOR/LIQUID SEPARATOR |

FIELD OF THE INVENTION

This invention relates to removal of halides, especially chlorides, from relatively dry liquid hydrocarbon streams such as reformate.

BACKGROUND OF THE INVENTION

Catalytic reforming, using Pt based reforming catalyst, is one of the most important refinery processes in the world. Most refineries have a catalytic reformer, which converts naphtha fractions into high octane reformate.

Reformers come in many types and sizes—from 2000 BPD fixed bed units to moving or swing bed units processing more than 50,000 BPD. Reformers are available with fixed bed reactors, swing bed reactors, or moving bed reactors. Many new units are moving bed reactors, available from UOP, Inc, Des Plaines, Ill.

Reformers generally use mono-metallic catalysts (Pt on a support such as alumina) or bi-metallic catalyst (Pt-Re on a support). Other combinations of Pt and other metals are known. All reforming catalyst are believed to contain a halide, almost invariably chlorine. The presence of chlorine is beneficial for the reforming process, and may be essential for successful regeneration of Pt catalyst, as the Cl helps keep the Pt dispersed as small crystals on the catalyst.

While all reformers are believed to have some chloride compounds in the reformate, the problem is most serious when a continuous reformer is used, and especially so when the catalyst is near the end of its useful life.

Some refiners add chlorine compounds continuously to their units to maintain a high chloride level on the catalyst. In continuous or moving bed reformers the catalyst is chlorided after coke burn but before return to the top of the reforming reactor. More chlorine is added now, as opposed to 10 or 20 years ago, both as a prophylactic measure to allow the units to be pushed harder, and the belief that catalyst regeneration is more successful with more Cl on catalyst.

Cl in the reformate causes problems in downstream units. The main chlorine compounds in reformate are believed to be HCl, NH4Cl and FeCl3. Some refiners may use other halides, such as Fl or I, but Cl is the halide of choice, so hereafter chlorine and its reaction or degradation products will be referred to rather than halogens in general.

Chlorine compounds in reformate cause several problems. Some regions have a pH specification on gasoline, which can not be met if large amounts of HCl are present in the reformate. Chlorides can seriously affect downstream processing units, such as a Sulfolane aromatics extraction unit, if the reformate is so treated.

Chlorides can cause very immediate problems in the reformer. If the reformer is relatively dry, as most are, the chlorides form salts which plug up the reformer fractionators. If water is added to wash the salts out then HCl is formed, which causes serious corrosion problems. As an example, one of our refineries had a problem with chloride salt buildup in product fractionators. Every three months or so the fractionator efficiency declined so that it was necessary to water wash the column. About 1 wt % water was added to the tower to wash out salts. This cleaned the column, but would also form some HCl, which can attack some steels, especially with water present.

The problem has gotten worse in the last decade, going from nuisance to a major problem. The conventional methods of handling chlorine in reformate will be briefly reviewed. These are grouped arbitrarily below and reviewed in detail hereafter.

1. Water washing,
2. Solid adsorbent treating of reformate,
3. Chemical treatments.

1. Water Washing

Water washing of a depropanizer fractionating tower that was part of a continuous catalytic reformer was reported in Example 2 of U.S. Pat. No. 4,880,568. Periodic water washing for a severe fouling and corrosion problems was not effective, therefore "an elaborate continuous water wash system was installed. The continuous water wash system also failed to solve the deposit problem."

Ex. 2 of '568 was directed to continuous or intermittent treatment of a chlorine containing fraction of a reformate.

Somewhat related is an aqueous, alkaline treatment of the reformate liquid upstream of the debutanizer. We tried a brief test in one of our commercial refineries at solving a chloride problem by injecting dilute caustic into reformate intermediate the V/L separator and the debutanizer. The caustic was less than 15° or 20°. A mesh pad was used to aid in separation of caustic/reformate in a separator vessel. The experiment was not considered a success. A flow control valve corroded, and the experiment was stopped.

2. Solid Adsorbent Treating

Some refiners use beds of solid adsorbent material to prevent chloride corrosion and fouling. More details about this type of treatment are available from UOP Inc which has endorsed use of at least one type of solid adsorbent to remove chlorides from reformate.

Such solid adsorbent beds can plug, and many refiners do not want to use that approach. Such adsorbents are also believed to be expensive, typically involving proprietary adsorbents. At least some of these proprietary materials are thought to be ineffective for removing NH4Cl.

Somewhat related to the above solid bed treatment of reformate streams is the use of a somewhat porous, relatively densely packed bed of granular alkalies to treat a variety of hydrocarbon streams in Sun U.S. Pat. No. 3,761,534, which is incorporated by reference.

Example 1 used 4–8 mesh granular NaOH to remove sulfuric acid from an alkylate stream of tert.-butylated ethyl-benzene containing about 0.3N total acid, primarily sulfuric acid. Although efficient acid removal first occurred, the bed plugged before 100 volumes of alkylate could flow through the bed.

Example 4 used no NaOH, but treated an effluent from the aklylation of benzene with ethylene in the presence of HCl with soda lime and glassmaker's (G.M.) alkali to remove acid.

Example 5 used pellets of C. P. NaOH to treat crude tert. butylated ethyl-benzene containing 570 ppm $H_2SO_4$. NaOH pellets plugged at 92 weights of alkylate per weight of alkali, while beds of soda lime and G. M. alkali did not plug.

Example 7 used G. M. alkali on a support grid to treat crude tert.butylated ethylbenzene containing about 600 ppm sulfuric acid. The organic flowed up through the support grid, through the alkali to an outlet above the bed of alkali. A white precipitate built up in the reservoir below the grid, which was periodically removed through a drain valve by a water purge. The bed of alkali was reported essentially unchanged by casual observation and there was no increase in resistance to flow through it.

The streams treated in '534 were probably saturated with water, as periodic water purges were reported in many examples. Some of the results reported could be summarized as follows:

Beds of caustic pellets do not work for very long to remove acidic contaminants from such liquid hydrocarbon streams.

All beds plug in downflow operation or rapidly lost effectiveness. Upflow operation with alkali on a support of a grid or coarse screen works a long time because salts that form can fall down through the screen.

Porous G.M. alkali was better than solid caustic.

3. Chemical Treatments

Several patents are directed at adding treatment chemicals which inhibit the formation of ammonium chloride in units, and are believed directed at keeping chlorine compounds in a form which will not precipitate as a solid in process equipment. Some treatment programs include chelating agents and/or film forming agents to prevent further corrosion.

U.S. Pat. Nos. 5,282,956 and 5,256,276, which are incorporated by reference, disclose inhibiting ammonium chloride deposition by adding an amide such as 1,3-dimethyl-2-thiourea or phosphatide such as lecithin.

U.S. Pat. No. 4,880,568, METHOD AND COMPOSITION FOR THE REMOVAL OF AMMONIUM SALT AND METAL COMPOUND DEPOSITS, Staley et al, Assignee Aqua Process, Inc., Houston, Tex. discloses injecting amines and chelating agents into reformate to remove and/or prevent formation of ammonium salt deposits. Amines added form amine salts with a low melting point or an affinity for trace amounts of water. This patent is incorporated by reference.

While adding chemicals to prevent formation of ammonium chloride deposits and/or chelating agents to remove metal corrosion products will help, such approaches are expensive and are not considered the ideal solution. Film forming agents may still be needed to protect metal surfaces in process equipment. Additives added will end up in one or more product streams, and these additives may cause additional problems downstream.

Many refiners would prefer to eliminate the problem, if possible, rather than add more chemicals to their reformate which must be dealt with in downstream processing units.

I studied the problem of chloride removal from reformate, and found nothing that was completely satisfactory.

The conventional approaches had several shortcomings. Unconstrained contact of reformate with dilute caustic was not successful in our refinery test. Continuous water washing was not successful in a depropanizer, as reported in U.S. Pat. No. 4,880,568.

I had concerns about adding more water to refinery streams. Catalytic reformate is a dry stream, passing through multiple distillation columns prior to reforming. Adding water to such a heretofore dry stream may (and has) cause corrosion or other problems in downstream units.

One of our refineries tried a proprietary method of dealing with chlorine in reformate involving addition of chemicals, but the cure was worse than the disease.

I wanted to remove chlorides entirely from the reformate, not merely convert them to less noxious materials. I wanted to remove them, but without adding other chemicals to the reformate stream, and especially without adding a lot of water to the reformate.

I was concerned that solid adsorbent beds were likely to plug and difficult to regenerate. I knew that a liquid based system could be made to work, as disclosed in my earlier application, Ser. No. 08/217821 filed on Mar. 25, 1994. There I disclosed a way to remove essentially all of the Cl from typical reformate streams using a water based reactive extraction process. While that process is a significant advance over the state of the art, it did have some disadvantages, which are reviewed below.

My earlier process used an aqueous solution of caustic, and this necessarily meant that the active reagent, NaOH or other alkaline material, was used in a somewhat dilute form. This meant that a liquid solution had to be prepared and perhaps stored. Some refiners were concerned that caustic in this form might be entrained in the reformate. The process also produced a relatively dilute brine byproduct as a result of removing halide from the liquid reformate stream.

I have now discovered a better way to remove halides from reformate and similar naphtha hydrocarbon streams which does not require any aqueous reagents. I found that solid caustic can efficiently remove halides from reformate in a three phase treating system.

One key to making the process work was selecting a stream which was relatively dry for treating, or rather in applying this process only to selected streams which were not saturated with water. If this process is tried on water saturated streams, the solid caustic bed will soon plug, and the desired form of salt precipitation, discussed below, will not occur.

By treating dry streams, with non-porous solid caustics in a bed with a large interstitial volume, most of the salt that forms from the neutralization reaction can be dissolved in a thin film on the surface of the solid caustic. As brine accumulates, it can drip or fall away from the solid caustic bed, and remove produced salt from the system.

Significant run lengths can be achieved when treating liquid hydrocarbon streams not saturated with water with a solid caustic bed coated with a film of brine. This makes the process a worthy substitute for alumina treaters.

BRIEF SUMMARY OF THE INVENTION

Accordingly, the present invention provides a process for producing a low halide reformate using a Pt and halide containing reforming catalyst comprising:

a. hydrotreating and distilling a naphtha fraction to produce a hydrotreated naphtha containing less than 1 wt ppm acidic halide compounds and less than 50 wt ppm water;

b. catalytically reforming said hydrotreated naphtha over a halide and Pt containing reforming catalyst at catalytic reforming conditions to produce a reformate liquid fraction containing at least 0.1 wt ppm acidic halide compounds and less than 50 wt ppm water; and c. reactively extracting acidic halide compounds by contact with solid caustic at reactive extraction conditions sufficient to remove at least a majority of said acidic halide compounds and produce a dehalided reformate which is removed from contact with said solid caustic as a product of the process.

In another embodiment, the present invention provides a process for removing chlorides from reformate comprising;

a) hydrating a dry reformate stream containing less than 10 wt ppm H2O and more than 0.5 wt ppm total chlorides so that the weight ratio of chlorides to total water is within the range of about 2:1 to 20:1 to produce a hydrated reformate;

b) removing at least 50 wt % of said chlorides by contacting said hydrated reformate with particles of solid caustic to produce caustic:chloride salts and water as a byproduct of said neutralization;

c) collecting at least a majority of said produced salts as an aqueous phase on a surface of said solid caustic and removing said produced salts from said reformate; and d) removing a treated reformate with a reduced chloride content from contact with said bed of solid caustic as a product of said process.

In yet another embodiment, the present invention provides a process for removing chlorides from a dry reformate stream containing less than 10 wt ppm H2O and more than 0.5 wt ppm total chlorides comprising:

a) hydrating at least periodically a bed of solid caustic with liquid water to form a wetted caustic bed with an aqueous film on at least some of said solid caustic;

b) removing at least 50 wt % of said chlorides in said dry reformate by contacting said reformate with said bed of solid caustic to produce caustic:chloride salts and water as a byproduct of said neutralization;

c) extracting at least a majority of said produced salts on said aqueous film; and d) removing as a product of said process a treated reformate with a reduced chloride content from said wetted bed of solid caustic.

DETAILED DESCRIPTION OF PREFERRED EMBODIMENTS

Figure 1:
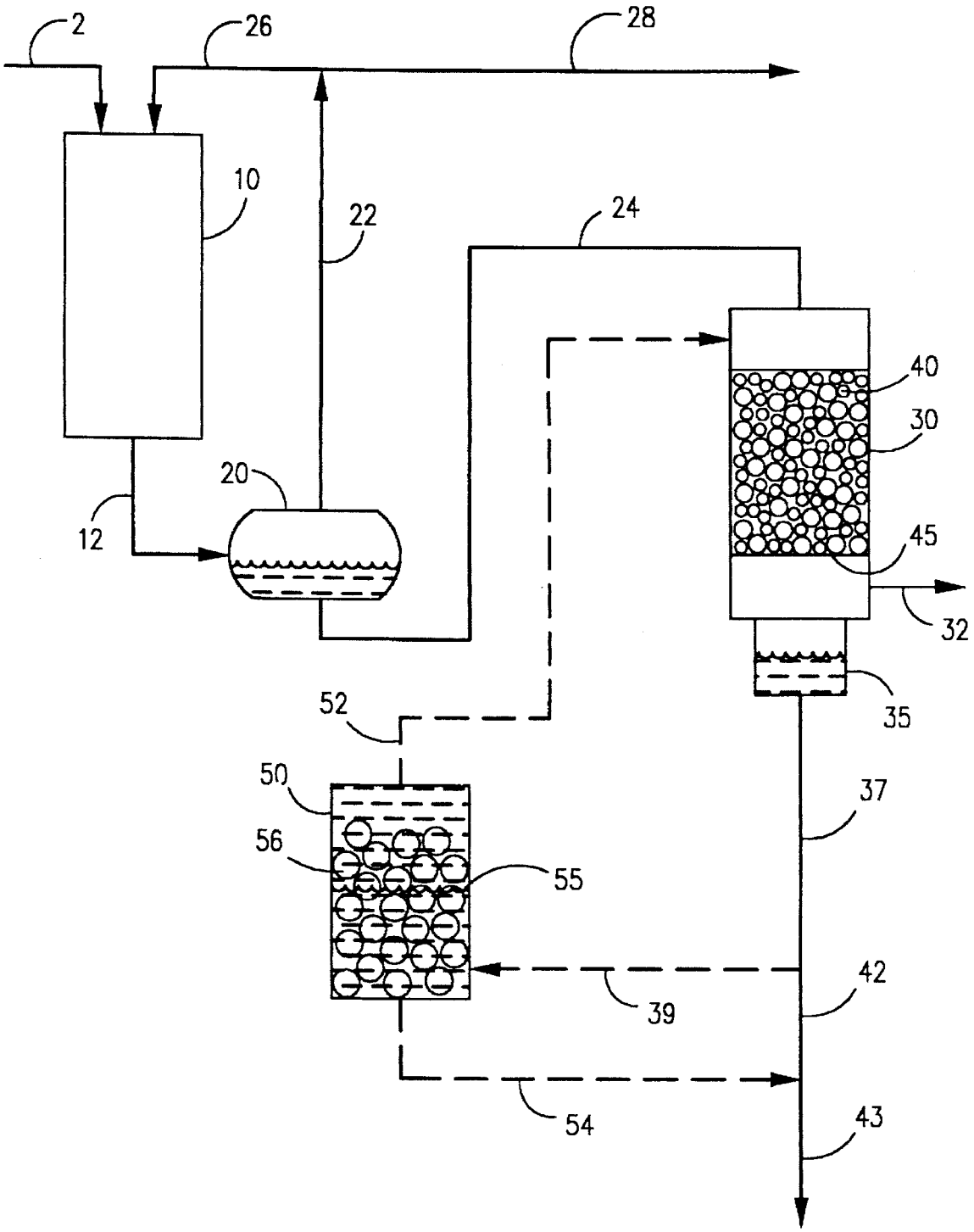
FIG. 1 is a simplified schematic view of a preferred solid caustic reactor for treating a liquid reformate stream.

The invention can be better understood in conjunction with a review of the Figure.

The Pt reformer is shown largely as a box 10, to which feed in line 21 and recycle hydrogen in line 26 are added and from which reactor effluent is removed via line 12. Not shown are heaters, pumps, valves and much other process equipment. Chlorine or compounds thereof will usually be injected either with the feed, or added directly or indirectly via catalyst regeneration. The reactor effluent vapor, after heat exchange with feed and cooling by means not shown, is charged via line 12 to vapor liquid separator 20. A recycle hydrogen stream is withdrawn from the separator via line 22 and recycled via line 26 to reactor 10. The net gas make is withdrawn via line 28. These parts of the reformer are conventional and form no part of the present invention.

Reformate liquid is withdrawn from the separator via line 24 and charged to solid caustic treater 30, shown partially in cross section. Basically the treater is a large fixed bed containing solid caustic. The caustic solids can be mixed with, or held by, solid supports such as activated carbon, woods, fibers, etc., or solid caustic pellets may be supported by a screen or grid 45 in the base of the treater.

Reformate is added to the top of the treater, passes down through bed 40, through screen 45 and is withdrawn via line 32 for further processing in means not shown, such as a conventional debutanizer. Reformate can also flow up through the bed.

A boot 35 is provided in the base of treater 30 for removal of produced brine. Ideally the process operates continuously, with chlorides continuously removed from the reformate stream, and resulting salt continuously collected in the aqueous film on the solid caustic, and the net salt production removed as brine droplets from the base of the treater.

If something goes wrong and the bed becomes plugged with salt, it may be beneficial to periodically rejuvenate the surface of the solid caustic using the solvent saturator and salt extractor discussed next.

The treater may be periodically removed from service or bypassed, for bed rejuvenation. For this, some reformate, or even fresh feed or other hydrocarbon liquid, is circulated in a loop from treater 30 to salt extractor 50 as discussed hereafter. A liquid hydrocarbon stream saturated with water and perhaps containing a minor amount of entrained water is charged via line 52 into the top of treater 40. The hydrocarbon continuous phase passes through the bed of solid caustic, and the water in the hydrocarbon selectively dissolves the soft salt deposits on the surface of the solid caustic pellets. A brine phase may form in boot 35 in the base of treater 30, with reformate or hydrocarbon charged via line 32 to downstream processing. In this type of operation the brine is simply removed via lines 37, 42 and 43 and discarded.

Alternatively, the entire hydrocarbon stream passing through the caustic bed is withdrawn via lines 37 and 39 and charged to solvent saturator and salt extractor 50. Water may be maintained in this vessel in the lower portion of a packed bed 56, with a water/hydrocarbon interface 55. Passage of the hydrocarbon phase through the water removes salt from the hydrocarbon, and saturates the hydrocarbon for reuse via line 52. A brine phase may be withdrawn via line 54 and sent via line 43 to the refinery waste treatment facility.

More details will now be provided about each part of the process.

CATALYTIC REFORMING

This process is well known and widely used, most refineries have catalytic reforming units. Essentially all catalytic reformers operate with chlorine addition, either to the catalyst prior to startup, to the feed during normal operation, or as part of a continuous catalyst regeneration unit associated with a moving bed reformer.

Reformers are available from several licensors. UOP Inc, Des Plaines, Ill. will provide both fixed and moving bed reforming units.

Conventional reforming conditions can be used, including a temperature of 850° to 1050° F., a pressure of atmospheric to 500 psig and a LHSV of 0.1 to 10 $Hr^{-1}$. Most reformers operate with recycle hydrogen, with from a 1:1 to 10:1 H2:hydrocarbon mole ratio.

CHLORINE IN REFORMATE

Moving bed units frequently produce reformate with more than 0.5 wt ppm Cl, and often in excess of 1 wt ppm Cl, and sometimes with 2 or 3+ wt ppm Cl. Fixed bed units operating with large amounts of Cl addition due to catalyst demands or imminent shutdown for regeneration can produce reformate with like amounts of Cl, though typically moving bed units have the highest Cl levels.

Chlorine levels may be continuously, or intermittently, troublesome. Chlorine in reformate will usually be highest just before regeneration (for fixed bed units) or just before replacement of catalyst (in the case of moving bed units).

Some refiners may use other halogens such as F in full or partial replacement of Cl. My process will efficiently capture these materials as well, but KOH should be used rather than NaOH to react with fluorides.

SOLID CAUSTIC TREATING

My process is very simple. Reformate contacts solid caustic. A thin film of brine on the solid caustic can be formed by spiking the reformate with water, or by allowing operation to continue with proper hydration of reformate which will soon generate, in situ, a brine layer on the solid caustic.

Even the chemistry of my process is simple. Simple neutralization reactions are involved which proceed rapidly. The primary reactions involved are:

$$HCl+NaOH \rightarrow NaCl+H_2O$$

$$NH_4Cl+NaOH \rightarrow NH_3+NaCl+H_2O$$

The reaction products are water and salt. The water is present in such small amounts that it remains dissolved in the naphtha which is charged to the debutanizer or enters the thin layer of brine on the solid caustic particles.

The solid caustic is preferably in the form of pure particles of a suitable caustic material, such as NaOH, KOH, CaO, MgO and the like. This material may be extruded, pilled, prilled, or formed using conventional techniques into any desired shape, preferably one with a high surface area to volume ratio which is mechanically strong and allows free flow of liquids.

To improve material handling it may be beneficial to add conventional solid supports to or around the solid caustic. Thus the caustic solids can be mixed with activated carbon, porous resins, woods, fibers and the like. When a support is used it preferably comprises a minority of the reactive solid, so that a majority, by weight, of the reactive solid used in the bed is caustic.

Alternatively the solid caustic may be in baskets or fiber bags, perforated tubes, trays or the like.

For a long bed life, the solid caustic used should be non-porous and have a relatively low surface area. Caustic beads or other mechanically strong form of solid caustic with a shape leading to a large void volume in the reactor are preferred.

While use of pure NaOH pellets—technical grade rather than reagent grade—is preferred for low cost, porosity and surface area, other materials such as glassmakers alkali (a mixture of about 20% $Ca(OH)_2$+80% NaOH), or KOH, soda lime, and like materials may also be used, though not necessarily with equivalent results.

At least a majority, and preferably at least 80%, and more preferably at least 90%, of the alkaline solid is NaOH or KOH.

The solid caustic can be used in the form of a high surface area material such as berl saddles, multi-lobed pellets, or the like. It is preferred to use a type of solid caustic which is non-porous, and has a large void volume. Non-porous caustics are less likely to crumble or collapse than porous materials. A large void volume will reduce the pressure drop associated with gas flow through the bed, and provide space for salt crystals to form and accumulate.

Expressed in terms of % interstitial volume, the bed should have at least 10% interstitial volume. If a 1 m cubic box of solid caustic could contain less than 0.1 cubic meters of mercury, the interstitial volume is too low.

Interstitial volumes of 10 to 50% will give good results, and preferably interstitial volumes are 12.5 to 40%, and most preferably are about 25 to 35%.

The solid caustics used preferably are relatively non-porous. One way to measure porosity is in terms of total surface area of the caustic, a measure of the external surface area of each particle or pellet and the internal surface area due to porous structure. The solid caustics used should have a total surface area of less than 1 $m^2/g$, and preferably less than 0.5, and most preferably less than 0.1 $m^2/g$.

The inexpensive, technical grade bead caustics commonly available have good properties for use herein. They have the shape of fairly uniform spheres and have an interstitial volume around 30–35%, and a low total surface area. I have not measured the surface area, but estimate it at less than 0.1 $m^2/g$.

I have tested these materials, and they work well. The three phase process also tolerates crushed caustics—which have a much higher surface area—but these are more susceptible to bed plugging from salt.

REACTION CONDITIONS

The reaction of halide species, usually chlorides, with solid alkaline materials proceeds rapidly. It is somewhat surprising to me that the reaction proceeds so rapidly, in that the water phase on the solid particles of caustic is not very alkaline (based on the pH of the brine drained off), and there is not very much surface area of water.

In functional terms, contact of liquid reformate with the solid caustic bed should be long enough to remove at least a majority, and preferably more than 90%, and most preferably more than 99% of the chlorides in the reformate. Short contact times reduce the size of the equipment, but may not remove enough chlorides, or may exhaust the supply of solid caustic too quickly.

In terms of space velocity, the LHSV may range from 0.1 to 100, and preferably from 1 to 30 LHSV.

Temperatures and pressures used are not narrowly critical. In general, the process works well at the conditions found downstream of the vapor/liquid separator of the reformer. Pressures should be high enough to maintain liquid phase operation, and temperatures may range from 5° to 100° C. or even higher, with temperatures of 10°–50° C. giving good results.

Caustic is used stoichiometrically, not catalytically. Caustic is continuously consumed and the solid bed will eventually need to be replenished or replaced. Although the process does not use a "catalyst" per se, and consumes itself for treating, the process operates a long time because the caustic is present as a high purity solid rather than a dilute liquid. The solid caustic bed will continue to react with chlorides until caustic consumption causes a breakthrough in Cl levels. At this point the process may be shut down briefly for caustic addition.

Alternatives for continuous operation include a swing reactor system, or a continuous addition systems with lock hoppers above and below the solid caustic bed, which can be used to add fresh solid caustic without stopping the flow of reformate.

Reactor Design

One of the most important features of the present invention is that is permits a relatively low tech reactor to do some efficient treating with cheap reagents. Refiners are very comfortable using simple, downflow, fixed bed reactors.

When a simple fixed bed reactor is used, with the solid caustic simply dumped onto a screen or dumped structured packing, the following guidelines can be given. The reactor preferably contains structured packing (~1–50% of reactor volume) in a lower portion of the reactor and then solid caustic (over 50% or reactor volume, and preferably 80–95% of reactor volume). Some of the volume of the reactor at the top can be empty, say 0–20% or less than 5%. The reactor can be very simple.

Either upflow, downflow or cross-flow operation is possible. Downflow operation will be preferred by many refiners, as such a bed will not be fluidized by any sudden changes in flow rates.

Cross-flow, especially if practiced in a radial flow reactor, greatly increases the cross sectional surface of the solid bed of caustic presented to reformate liquid.

Most refiners will prefer to use a simple fixed bed system. The process provides satisfactory run lengths, despite using a bed which is consumed during the halide removal process.

Long runs are achieved when treating, e.g., a reformate because the bed contains solid caustic, rather than a dilute solution of caustic, and the flowing reformate fed to the reactor usually contains less than about 1 wt ppm Cl.

EXAMPLES

Feed

A composite of products from a continuous catalytic reformer (CCR) pilot plant was used as the base feed. The typical reforming severity was 101 RON/91.6 MON for the $C_6$+ product. The moisture content was determined to be 7 ppm, while chloride was determined using a chloride electrode to be 0.23 ppm. For testing in the process, the base feed was doped with 10 ppm of $Cl^-$ from HCl, 10 ppm of $Cl^-$ from $NH_4Cl$ and 0.1 ppm $Cl^-$ from $FeCl_3$. In doping the feed with chlorides, the moisture content of the feed was increased from 7 to 10 ppm.

Reactor

The reactor is a ⅜" stainless steel tube fitted with a check valve and TEE. Right above the tee, the tube was packed with 1 cc of stainless steel cannon packings, and then 5 cc of NaOH beads. The tube above the solid caustic bed is empty. The reactor temperature was controlled by use of a heat tape.

Operating Procedure

The reactor was filled with the solid caustic before startup. The feed was pumped up through the bed at 20 cc/hr., 80° F. at about 50 psi. The chlorides react with the solid caustic. The empty tube above the bed provided the opportunity for settling if needed. Finally, the reformate product was recovered for analyses.

Analysis

1. Chloride: The product was extracted with 1/10th volume of water using an efficient plunger type mixer. The water phase was analyzed for chloride using a chloride electrode (Model 94-17B by Orion). The samples were also sent to our analytical lab confirmation purposes.
2. Moisture: The moisture contents were analyzed using Parametric (Model 2000) analyzer. Unfortunately, the Karl-Fisher titrator was not sensitive enough for feeds with such a low moisture content. Samples were also sent to our analytical lab to test for moisture for confirmation.
3. Caustic/brine: The product was extracted with 1/10 volume of distilled water of pH=7. The pH of water phase is measured as an indication of product alkalinity.

Figure 2:
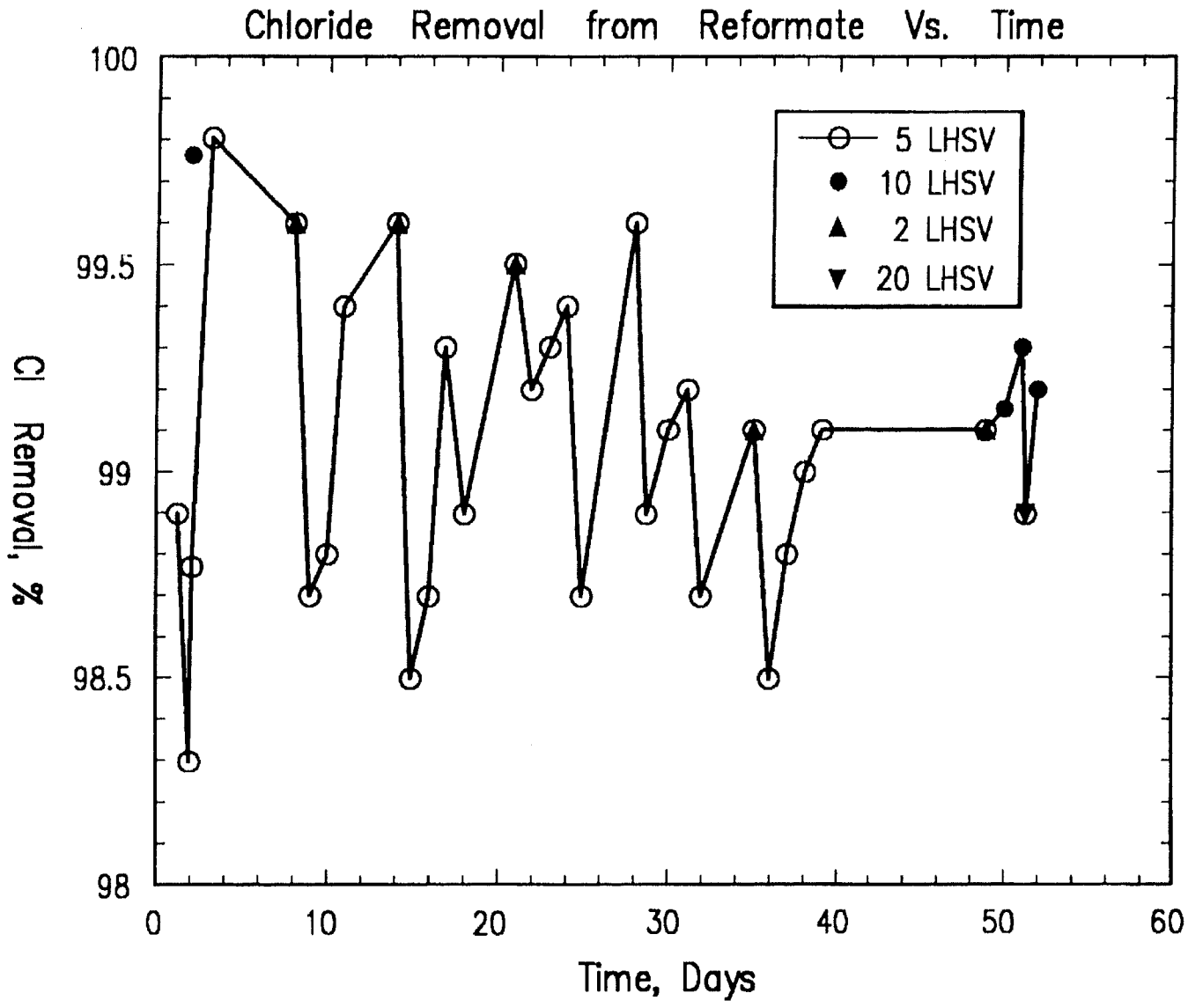
FIG. 2 is a graphical presentation of a two month test of my three phase extraction system on removing chlorides from reformate.

The experimental results are presented in FIG. 2.

DISCUSSION

1. Efficacy of the Process

The process is effective in removing chlorides.

Although the chloride balances varied a lot from run to run (some salt can hang up on a wall and be released in the next run) it appears to be averaging at about 71%.

Although the chloride balance is poor, it is believed that the percentage reduction in $Cl^-$ is a good indication of the efficacy of this process.

The efficacy of the process is believed due to the high rate of the neutralization reaction. The reactions are simple neutralizations with rates too fast to measure. The efficacy of the process is assured by providing intimate contact between the oil droplets and solid caustic in the bed. The solid caustic is wetted with water of neutralization or perhaps from water in the reformate, and this forms a skin of caustic solution which efficiently removes chlorides from the reformate.

2. Moisture Content of Product

The product can be very dry. It is possible to run the process so that little water is added to the reformate.

It is interesting to note that in the process, chlorides were extracted from the reformate without saturating the reformate with water. This is accomplished in part by taking advantage of different relative mass transfer rates of chlorides from reformate to water and water to reformate. The chlorides move rapidly from the reformate to the water phase because of the high affinity and reactivity of chlorides with the caustic film which forms on the surface of the solid caustic. On the other hand, the dissolution of water into reformate is a slow diffusion process with a small driving potential.

3. NaOH in Reformate

The NaOH (and brine) carry over in the reformate product appears to be very low. Very little if any of the constrained aqueous phase on the solid caustic migrated into the reformate.

The specification of alkalinity content in the finished gasoline is 0.5 ppm. This specification can be easily met by the process of the present invention.

4. pH of Produced Brine

The pH of the brine removed from the solid caustic bed was, surprisingly, almost neutral. The chloride concentration of this material is preferably relatively high to minimize the volume of brine sent to the refinery sewer system.

My process may also be used to remove chlorides or other halides from isomerate from an isomerization unit using a catalyst on a halide containing support, or using a halide containing catalyst.

I prefer to charge to my process streams which boil in the naphtha range, are fairly clean streams, and which are dry. Use of my process on wet streams, or streams containing large amounts of dissolved or entrained water, would result in excessive consumption of caustic and production of a corrosive aqueous waste stream.

WATER CONTROL

Many reformates will have sufficient water present in them, or sufficient water will form due to the neutralization reaction, to permit the process to operate effectively without water addition. Some reformate streams will be too dry, or contain such large amounts of chlorides, that more water will be needed for effective operation. The same reformer can produce reformate streams with sharply varying chloride levels depending on the reformer cycle. With fresh catalyst, in the winter months when flow rates and octane requirements (and catalyst regeneration frequency) are low there will be little chloride in the reformate. Summer months, catalyst due for replacement, etc. can increase chloride contents by a factor of 5 or 10 relative to other times.

It is possible to maintain chloride removal at high efficiency and minimize caustic usage and disposal problems. This can be done by controlling the amount of moisture in the system.

For the system studied, the test feed had about 10 ppm of Cl, and the $H_2O$ content of the feed was about 50 ppm. The ratio of $H_2O$ (ppm) to Cl (ppm) is 5. This gives good results. This level of $H_2O$ is what prevails in many Pt reforming units. Good results can be achieved when the water content is adjusted as necessary so that the following ratios of halide to water are maintained. As most of the halide content will be chlorine, the ratios are given as $H_2O$:Cl ratios. Good results can be achieved with ratios of 1:1 to 50:1, on a weight ppm basis. Better results are achieved when this ratio is 2:1 to 20:1, and excellent results are achieved with a ratio of about 3:1 to 10:1. Optimum results are believed to be reached with a 4.1:1 ratio. Thus water addition could be based on analytical results to ensure efficient use of caustic and efficient chloride removal.

Operating with too little water, relative to chloride could decrease bed efficiency because of a buildup of salt on the solid caustic. Operation with too much water would dissolve the caustic and produce a very alkaline disposal problem.

While a basic analytical approach can be used, adjusting water contents to match an analyzed chloride content, a simple and highly reliable control method was developed. Operate the chloride extraction reactor so that the brine phase produced had a pH below 9.0, preferably below 8.5, and most preferably about 8.0. This translates in practice into a caustic utilization efficiency of about 90% and produces an alkaline brine which can be disposed through sewage and other regular water systems.

I claim:

1. A process for producing a low halide reformate using a Pt and halide containing reforming catalyst comprising:

a. hydrotreating and distilling a naphtha fraction to produce a hydrotreated naphtha containing less than 1 wt ppm acidic halide compounds and less than 50 wt ppm water;

b. catalytically reforming said hydrotreated naphtha over a halide and Pt containing reforming catalyst at catalytic reforming conditions to produce a reformate liquid fraction containing at least 0.1 wt ppm acidic halide compounds and less than 10 wt ppm water;

c. adding additional water to the reformate so that the weight ratio of halide to (native +added) water is within the range of 1:1 to 50:1 and d. reactively extracting said liquid reformate acidic halide compounds by contact with particles consisting essentially of solid caustic having at least 10% interstitial volume at reactive extraction conditions sufficient to remove at least a majority of said acidic halide compounds and produce a dehalided reformate which is removed from contact with said solid caustic as a product of the process.

2. The process of claim 1 wherein the halide is chlorine.

3. The process of claim 1 wherein the liquid reformate contains more than 0.5 to 50 wt ppm chlorine as HCl, $NH_4Cl$, $FeCl_3$ and mixtures thereof, and less than 10 wt ppm water and wherein more than 90% of said chlorine is removed.

4. The process of claim 1 wherein said solid caustic comprises at least 0.01 wt % NaOH, KOH or mixtures thereof.

5. The process of claim 1 wherein said solid caustic is essentially pure NaOH.

6. The process of claim 1 wherein said solid caustic contains or is mixed with a solid support.

7. The process of claim 6 wherein said solid caustic is contained in porous bags, perforated pipe, or screens.

8. The process of claim 7 wherein said fixed bed has a height and contacting occurs by upflow of reformate through said solid caustic.

9. The process of claim 1 wherein said ratio of halide to (native+added) water is about 2:1 to 20:1.

10. The process of claim 1 wherein said ratio of halide to (native+added) water is about 3:1 to 10:1.

11. The process of claim 1 wherein said solid caustic is maintained as a fixed bed and an aqueous film comprising native water, added water, and water formed due to a neutralization reaction of halides with said solid caustic or with an aqueous phase containing dissolved solid caustic and reformate flows down through said fixed bed at a rate sufficient to displace at least some of said aqueous film from said solid caustic.

12. A process for removing chlorides from reformate comprising;

a) hydrating a dry reformate stream containing less than 10 wt ppm H2O and more than 0.5 wt ppm total chlorides so that the weight ratio of chlorides to total water is within the range of about 2:1 to 20:1 to produce a hydrated reformate;

b) removing at least 50 wt % of said chlorides by contacting said hydrated reformate with particles of solid caustic to produce caustic:chloride salts and water as a byproduct of said neutralization;

c) collecting at least a majority of said produced salts as an aqueous phase on a surface of said solid caustic and removing said produced salts from said reformate; and d) removing a treated reformate with a reduced chloride content from contact with said bed of solid caustic as a product of said process.

13. The process of claim 12 wherein said caustic is NaOH.

14. The process of claim 12 wherein said hydrated reformate has a weight ratio of chlorides to total water of about 3:1 to 10:1.

15. A process for removing chlorides from a dry reformate stream containing less than 10 wt ppm H2O and more than 0.5 wt ppm total chlorides comprising:

a) hydrating at least periodically a bed of solid caustic with liquid water to form a wetted caustic bed with an aqueous film on at least some of said solid caustic;

b) removing at least 50 wt % of said chlorides in said dry reformate by contacting said reformate with said bed of solid caustic to produce caustic:chloride salts and water as a byproduct of said neutralization;

c) extracting at least a majority of said produced salts on said aqueous film; and d) removing as a product of said process a treated reformate with a reduced chloride content from said wetted bed of solid caustic.

* * * * *